United States Patent [19]

Champlin

[11] 4,284,195

[45] Aug. 18, 1981

[54] CARRIER AND HANDLE

[75] Inventor: Charles L. Champlin, Rittman, Ohio

[73] Assignee: Packaging Corporation of America, Evanston, Ill.

[21] Appl. No.: 115,054

[22] Filed: Jan. 24, 1980

[51] Int. Cl.[3] ..... B65D 65/32; B65D 75/56; B65D 5/46

[52] U.S. Cl. ..... 206/427; 206/165; 206/166; 229/52 BC

[58] Field of Search ..... 229/28 BC, 52 B; 206/165, 166, 427, 506

[56] References Cited

U.S. PATENT DOCUMENTS

| | | | |
|---|---|---|---|
| 2,373,851 | 4/1945 | Potter | 206/165 |
| 2,609,137 | 9/1952 | Toensmeier | 229/28 BC |
| 2,681,143 | 6/1954 | Guyer | 229/52 B X |
| 3,197,116 | 7/1965 | Zastrow | 229/52 B |
| 3,744,704 | 7/1973 | Struble | 229/28 BC |
| 3,807,625 | 4/1974 | Akkerman | 229/52 B |
| 3,940,055 | 2/1976 | Rowley | 229/52 B |
| 3,952,940 | 4/1976 | Malcolm | 229/52 B X |
| 4,146,168 | 3/1979 | Hartline | 229/28 BC |

*Primary Examiner*—Davis T. Moorhead

*Attorney, Agent, or Firm*—Neuman, Williams, Anderson & Olson

[57] ABSTRACT

A carrier and handle therefor are provided which are formed from a blank of foldable sheet material. The handle includes a pair of spaced, depending end means and a hand-gripping unit which spans the distance between the end means and is foldably connected thereto. The unit is provided with a pair of elongated panel sections arranged in upright face-to-face relation and having upper peripheral segments thereof interconnected by an elongated foldline, the ends of which are spaced inwardly from the end means. Gusset sections are interposed the ends of the foldline and the adjacent end means. Each gusset section includes foldably connected first and second members. Each first member is foldably connected to corresponding peripheral portions of the panel sections. The second member of each gusset section is foldably connected to an upper peripheral portion of the adjacent end means. The hand-gripping unit is manually adjustable between operative and inoperative modes. When in an operative mode, the foldline connecting the panel sections is elevated relative to the upper peripheral portions of the end means. When the unit is in an inoperative mode, the said foldline is not elevated relative to the end means upper peripheral portions.

14 Claims, 17 Drawing Figures

FIG. 1
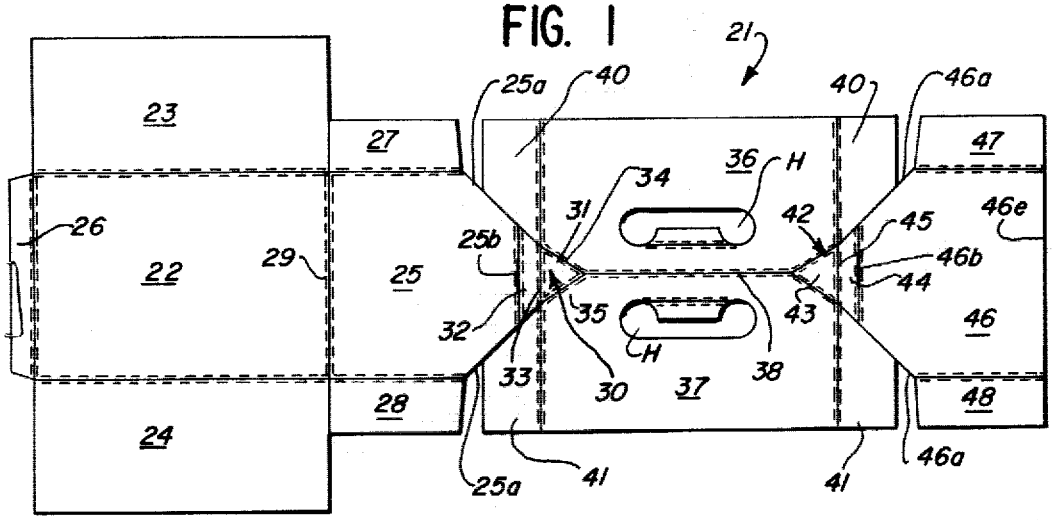
FIG. 2
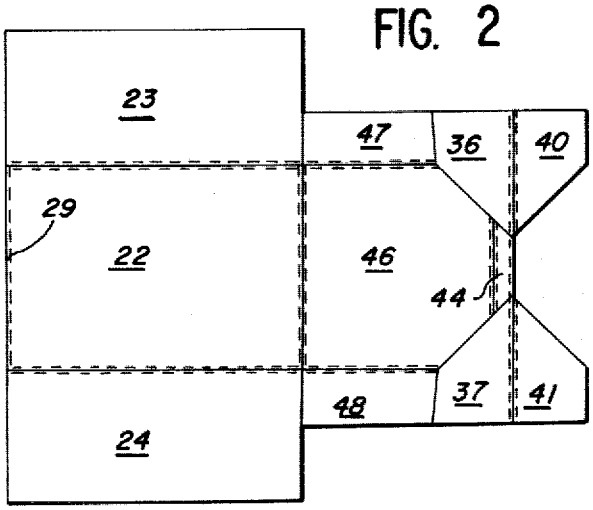
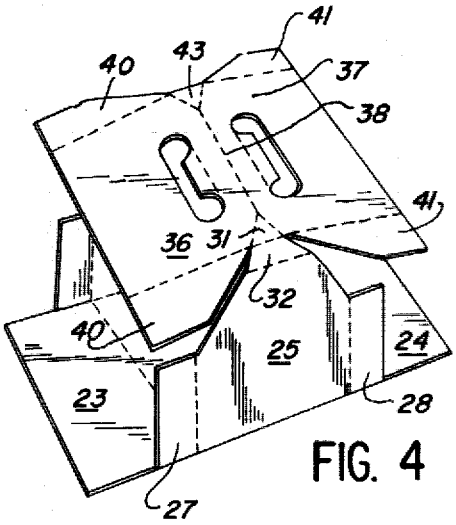
FIG. 4
FIG. 3
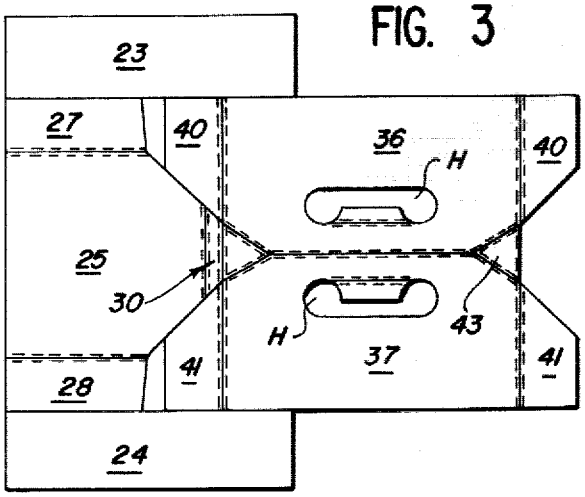
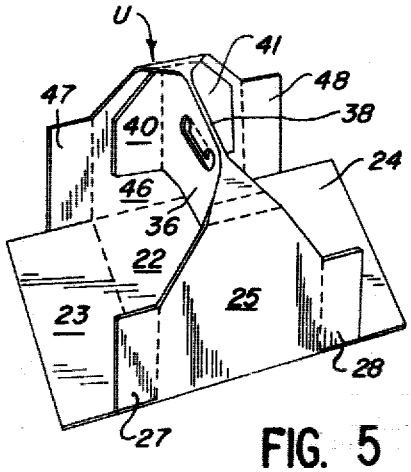
FIG. 5

FIG. 6
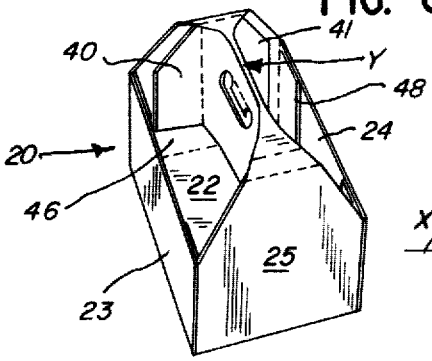
FIG. 7
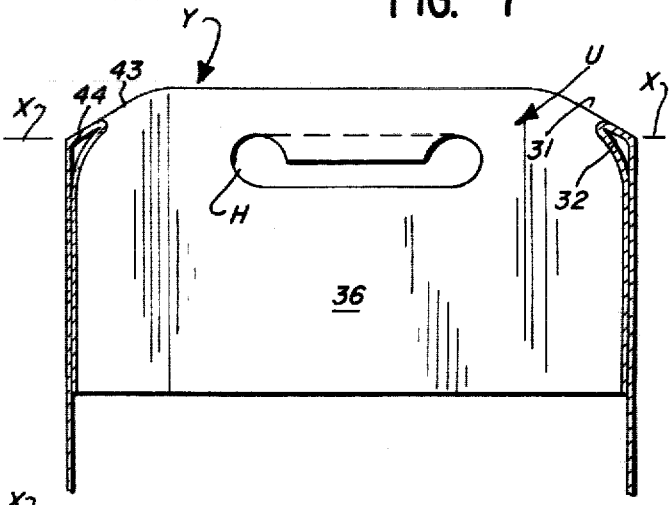
FIG. 9
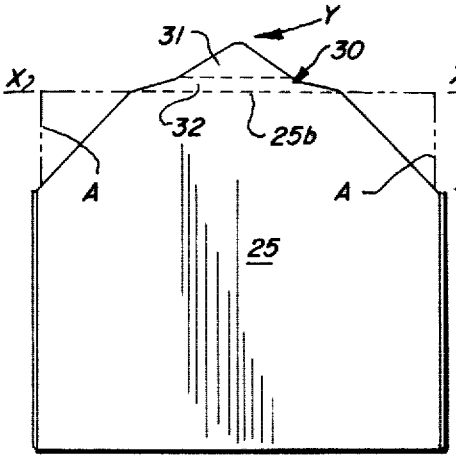
FIG. 8
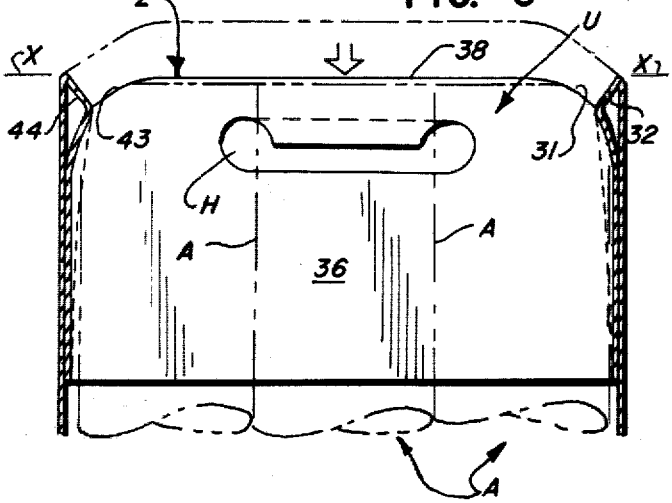
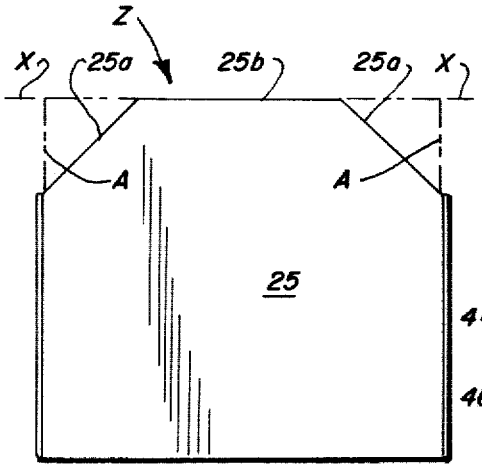
FIG. 10
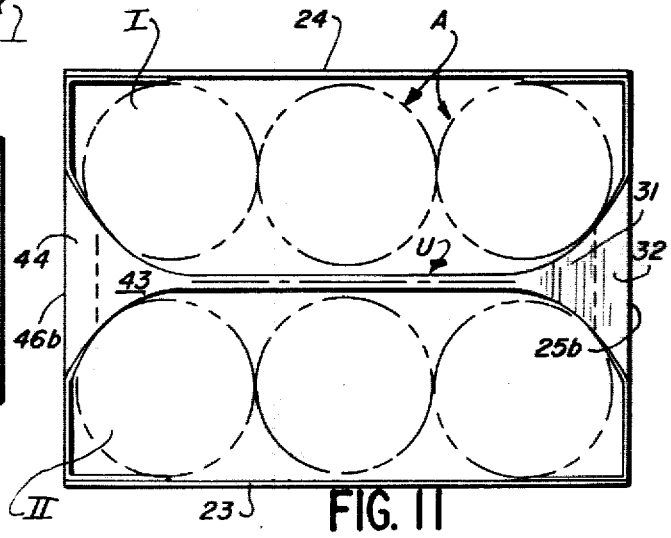
FIG. 11

FIG. 15
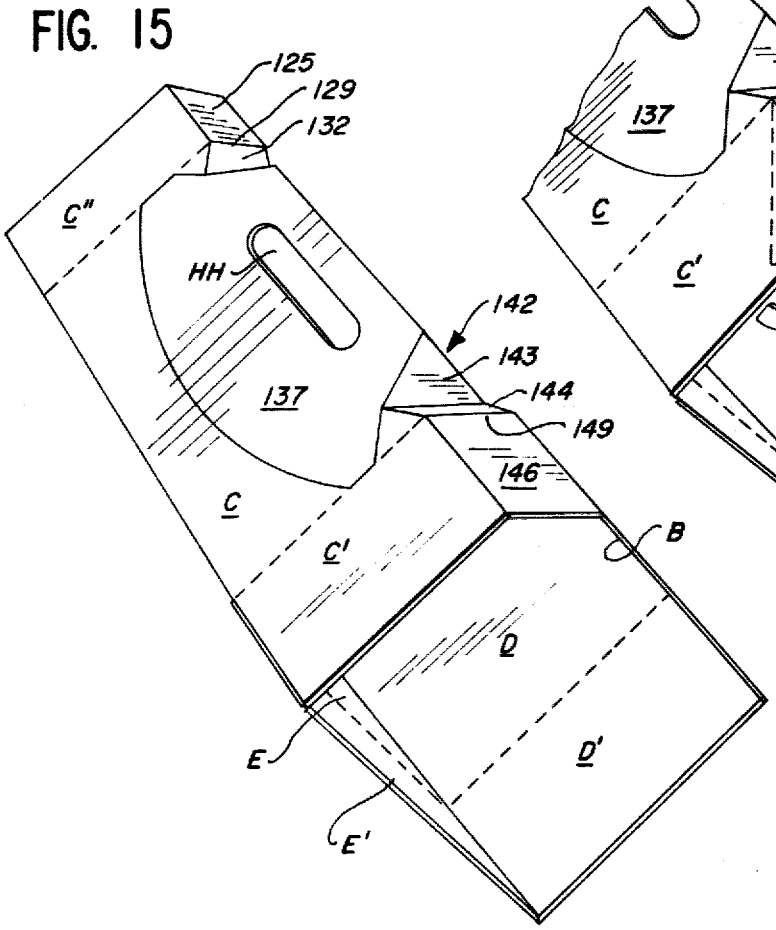
FIG. 15a
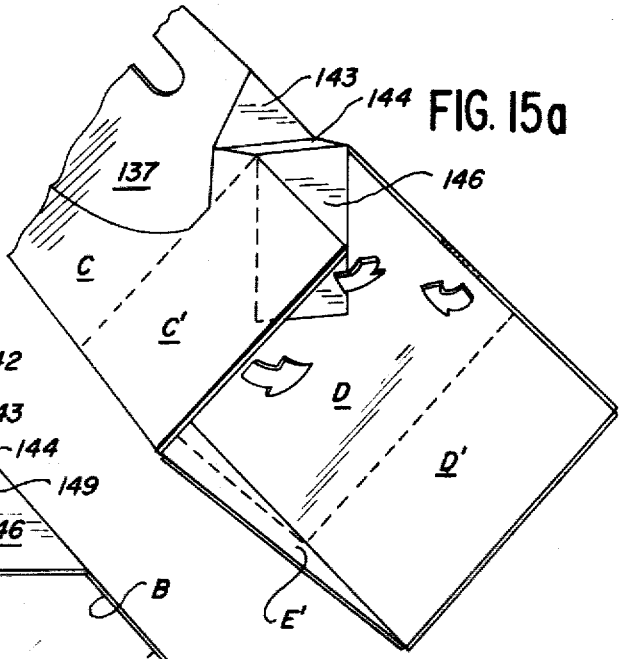
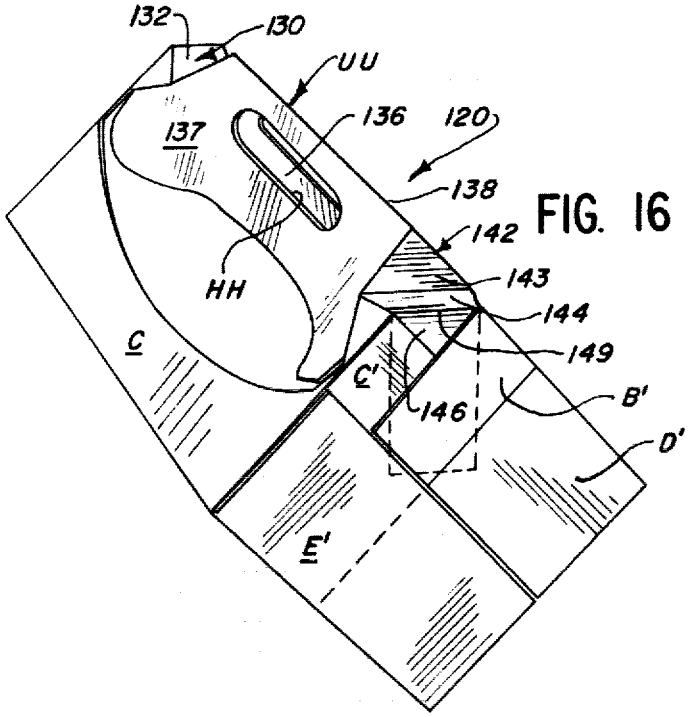
FIG. 16

CARRIER AND HANDLE

BACKGROUND OF THE INVENTION

Packaging of a plurality of articles (e.g., bottles or cans) in basket-type carriers has become increasingly popular, particularly where the packaged articles, when empty, are requested to be returned to the place of purchase. Thus, the carrier must be of rugged, sturdy construction and capable of repeated usage and easy to manually reload.

Various carriers of this general type have heretofore been provided, however, because of certain inherent design characteristics, such carriers, are beset with one or more of the following shortcomings: (a) the carrier and handle therefor require an inordinate amount of material and are difficult and awkward to set up; (b) the carrier handle remains in a fixed extended position thereby oftentimes interfering with the stacking of a plurality of loaded carriers; (c) the handle is weak and uncomfortable to grasp for any extended period of time; (d) the carrier is incapable of accommodating a variety of articles; and (e) the carrier handle is disposed in such a way relative to the accommodated articles that the accessibility of the handle for gripping is impaired.

SUMMARY OF THE INVENTION

Thus, it is an object of the invention to provide a carrier and handle therefor which avoid the aforenoted problems associated with the prior art structures.

It is a further object to provide a carrier and handle therefor set up from a blank which may be formed on conventional high-speed scoring, cutting, and slotting equipment.

It is a further object to provide a carrier which may be readily loaded and unloaded with automatic or semi-automatic apparatus.

Further and additional objects will appear from the description, accompanying drawings, and appended claims.

In accordance with one embodiment of the invention, a carrier and handle therefor are provided which are formed from a single blank of foldable sheet material. The handle includes a pair of depending end means and a hand-gripping unit spanning the distance between the end means and being foldably connected thereto for movement between operative and inoperative modes. The unit embodies a pair of elongated panel sections arranged in face-to-face relation and having corresponding upper peripheral segments thereof interconnected by an elongated foldline. The ends of the foldline are spaced inwardly from the interior surfaces of the end means. Interposed each foldline end and the adjacent end means is a gusset section. Each gusset section includes first and second members which are foldably connected to one another. The first member has a substantially triangular configuration with one side connected to the second member. The remaining sides of the first member are foldably connected to corresponding peripheral portions of the unit panel sections. One apex of the triangular first member is disposed at one end of the foldline interconnecting the panel sections. The second member of each gusset section has one peripheral portion thereof foldably connected to an upper peripheral segment of the adjacent end means. The folding connection between the first and second members and the folding connection between the second member and the adjacent end means are disposed in spaced, substantially parallel relation. When the hand gripping unit is in the inoperative mode, the foldline interconnecting the panel sections does not project above a plane defined by the upper peripheral segments of the end means. When, however, the hand-gripping unit is in its operative mode, the foldline projects above the said plane thereby facilitating manual gripping of the unit.

DESCRIPTION

For a more complete understanding of the invention reference should be made to the drawings wherein:

FIG. 1 is a plan view of a blank for one form of the improved carrier and handle.

FIG. 2 is similar to FIG. 1, but showing the blank in a first folded condition for setting up one form of the improved carrier.

FIG. 3 is a back view of the folded blank of FIG. 2.

FIGS. 4 and 5 are reduced top perspective views of the blank of FIG. 3 shown in successive steps of set up.

FIG. 6 is a reduced top perspective view of one form of the improved carrier set up from the blank of FIG. 1.

FIGS. 7 and 8 are enlarged fragmentary side elevational views of one form of the improved handle shown, respectively, in operative and inoperative modes.

FIG. 9 is an enlarged end view of the carrier of FIG. 6 showing the handle thereof in an operative mode; the articles accommodated in the carrier being shown in phantom lines.

FIG. 10 is similar to FIG. 9, but showing the handle thereof in an inoperative mode.

FIG. 11 is an enlarged top plan view of the carrier of FIG. 6 with the articles accommodated therein being shown in phantom lines.

FIG. 15 is a perspective end view of the blank of FIG. 14 in a squared up condition.

Figure 12:
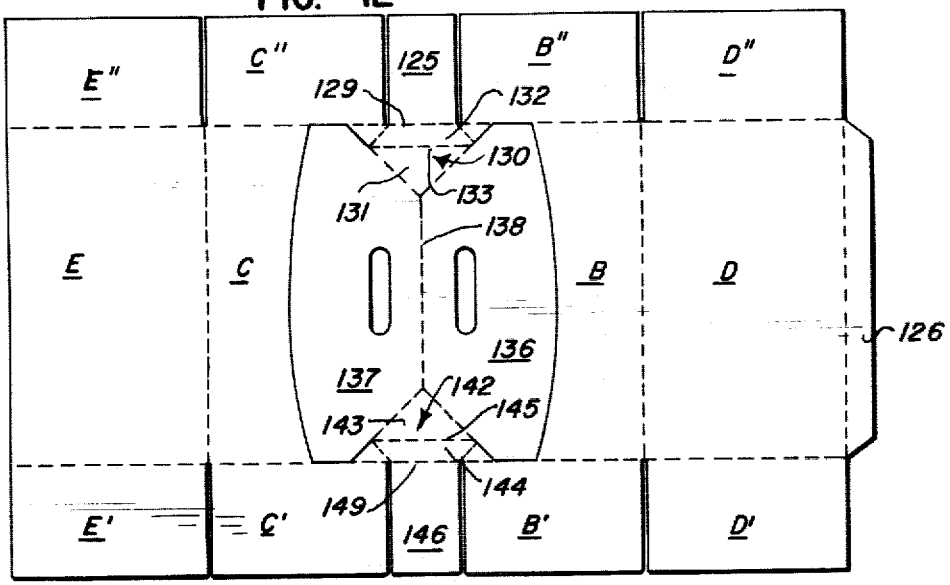
FIG. 12 is a plan view of a blank for a second form of improved carrier.
Figure 14:
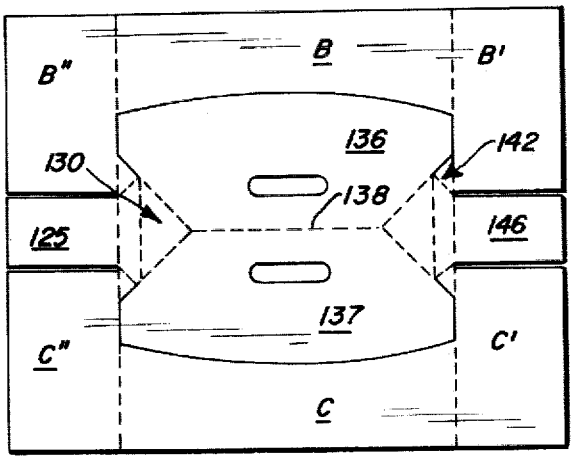
FIG. 14 is a top view of the blank of FIG. 13.

FIG. **15*a* is a fragmentary perspective view of one end of the squared up carrier of FIG. 15** and showing the end flap in a depending position.

FIG. 16 is similar to FIG. 15, but showing the end closure flaps in a folded state and forming an end wall of the carrier and with the hand-gripping unit thereof in an inoperative mode.

Referring now to the drawings and more particularly to FIGS. 6–11, one form 20 of the improved carrier is shown which, in the illustrated embodiment, is adapted to accommodate a plurality of articles A. The articles may be cans or bottles which are disposed in two parallel rows, each row being of three articles arranged in side-by-side relation. The number, type, and size of articles may vary from that shown, if desired. The carrier 20 is formed from a blank 21 of foldable sheet material, such as paperboard or double-face corrugated fiberboard.

As seen in FIG. 1, blank 21 includes at one side thereof a bottom panel 22 which subtends and supportingly engages the accommodated articles A. Extending laterally from opposite sides of panel 22 and foldably connected thereto are side panels 23, 24. Foldably connected to an end edge of panel 22 is an end panel 25. A manufacturer's glue flap 26 may be foldably connected to the opposite end edge of panel 22.

Extending laterally from opposite sides of end panel 25 are tuck flaps 27, 28. It will be noted that the tuck flaps do not extend the full height of the end panel when the carrier 20 is fully set up because the upper side edge portions 25*a* of the sides of the end panel are tapered, or converge, towards one another to form a narrow upper edge 25*b*. Foldably connected to the edge 25*b* is a gusset section 30 which includes first and second members 31, 32, respectively. The members are joined together by a foldline 33 which is in spaced, parallel relation with respect to the upper edge 25*b* of the adjacent end panel 25.

The first member 31 of the gusset section 30 has a triangular configuration with the base thereof being defined by the foldline 33. The remaining two sides of member 31 are defined by foldlines 34, 35 which join corresponding peripheral portions of panel sections 36, 37, respectively.

Panel sections 36, 37 are of like configuration and in the blank 21 extend endwise from the gusset section 30. The panel sections 36, 37 are disposed in side-by-side relation and are foldably connected to one another by an elongated foldline 38. The opposite ends of each panel section 36, 37 are foldably connected to flaps 40, 41 which provide a shadow-box effect when the blank is fully set up to form carrier 20, as will be described more fully hereinafter.

Disposed at the opposite end of foldline 38 is a second gusset section 42 which is of the same configuration as gusset section 30. First and second members 43, 44, respectively, of gusset section 42 are interconnected by foldline 45. Second member 44 is foldably connected to a narrow upper edge 46*b* of an end panel 46. End panels 25, 46 are of like configuration. Tuck flaps 47, 48 are foldably connected to opposite sides of end panel 46 in the same manner as tuck flaps 27, 28 are with respect to end panel 25. Corresponding upper side edge portions 46*a* of the end panel 46 are in convergent relation and terminate at their upper end limits at a narrow edge 46*b*. The lower, or opposite, edge 46*c* of end panel 46 is adhesively, or otherwise, secured to the manufacturer's glue flap 26 when the blank is set up to form carrier 20.

In setting up blank 21 to form carrier 20, end panel 46, associated flaps 47, 48, and second member 44 of gusset section 42, are initially folded as a unit about the foldline 45 as an axis. Prior thereto, however, bottom panel 22, side panels 23, 24, and manufacturer's glue flap 26 are folded as a unit about a foldline 29 as an axis, so that the lower edge portion 46*c* of end panel 46 will overlie and be adhesively secured to glue flap 26, see FIGS. 2 and 3. Foldline 29 interconnects the end edge of bottom panel 22 to the lower edge of end panel 25. When the blank is in the partially folded condition shown in FIGS. 2, 3, it is suitable for bulk storage or shipment to the customer.

When the partially folded blank is to be set up for loading, the end panels 25, 46 are squared up with respect to bottom panel 22 whereby the panel sections 36, 37 and associated flaps 40, 41 are disposed in spaced, substantially parallel relation with respect to the bottom panel 22 and associated side panels 23, 24, see FIG. 4. Prior to side-loading the carrier, the panel sections 36, 37 and associated flaps 40, 41 are folded as a unit relative to one another about foldline 38 as an axis so that panel sections 36, 37 will assume a substantially face-to-face engagement with one another, see FIG. 5. As the panel sections are moved into face-to-face relation, the shadow-box flaps 40, 41 are automatically folded into sliding engagement with the interior surfaces of the end panels 25, 46 by the upright convergent side edge portions 25*a*, 46*a* of the end panels. The shape of the flaps 40, 41 may be such that they overlie and substantially conceal the upper portions of the end panel interior surfaces and thus, give a more finished and attractive appearance to the carrier. When the blank is formed of a paperboard material which is finished and printed on only one surface thereof, the concealing of the interior surface portions of the end panels is particularly important from a marketing standpoint. If desired, however, the flaps 40, 41 may be omitted.

After the panel sections 36, 37 and flaps 40, 41 have assumed the positions shown in FIG. 5, the articles, (e.g., cans or bottles) may be automatically loaded from opposite sides into the partially folded carrier by high speed, automatic equipment commonly utilized in the packaging field.

The panel sections and flaps 40, 41 form a sturdy hand-gripping unit U which effectively serves to separate the loaded articles into two separate rows I, II of three articles each. The panel sections 36, 37 depend into the interior of the carrier so as to prevent the corresponding articles of the rows from clicking or striking one another.

When the panel sections and associated flaps assume the relative positions shown in FIG. 5, the foldline 38 forms an elongated rib which is elevated a substantial distance relative to a plane X—X defined by the narrow upper edges 25*b*, 46*b* of the upright end panels. This relationship is clearly shown in FIGS. 7, 8. It should be noted that the tops of the accommodated articles normally lie within plane X—X. The importance of this feature will become evident from the description to follow.

Once the articles A have been loaded into the partially folded carrier of FIG. 5, the tuck flaps 27, 28 and 47, 48 are folded inwardly so as to partially overlie the outwardly disposed surfaces of the articles forming the adjacent row. Subsequent thereto, the corresponding side panels 23, 24 are then folded to upright positions and adhesively secured to the pre-folded tuck flaps 27, 28 and 47, 48, see FIG. 6.

Where the articles are to be loaded through the open top of the carrier, the afore-described set-up steps are followed, except for the step of side-loading the articles. When the articles are reloaded into the carrier for return to the place of purchase or the like, top loading of the carrier obviously occurs.

Because of the gusset sections 30, 42, the hand-gripping unit U may be manually adjusted to either an operative mode Y, see FIGS. 6, 7, and 9, or an inoperative mode Z, see FIGS. 8, 10. As aforementioned, the operative mode Y is when the hand-gripping unit U assumes a fully extended position wherein the rib-forming foldline 38 is elevated to the greatest extent with respect to plane X—X. When in this position, hand-holes H formed in the panel sections 36, 37 are most accessible for enabling the fingers of the person holding the loaded carrier to pass therethrough. On the other hand, when the unit U is in its inoperative mode Z, FIGS. 8, 10, the hand-holes are less accessible and the foldline 38 is flush or recessed relative to plane X—X and thus, in no way interferes with stacking of similar loaded carriers for display purposes or the like.

When in mode Y, the members 31, 32, or 43, 44 of each gusset section are in substantially coplanar relation and the gusset sections are disposed in upwardly extending convergent relation, see FIG. 7.

As aforementioned, having the unit U in mode Y, the accessibility of the hand or finger holes H is substantially improved and interference by the tops of the accommodated articles is minimized or avoided completely. In instances where the accommodated articles are capped, necked bottles, the accessibility of the hand holes H is improved even further when the unit U is in mode Y.

When the unit U is in an inoperative mode Z, see FIG. 8, members 32, 44 of the gusset sections 30, 42, respectively, extend downwardly and inwardly into the interior of the carrier and the respective members 31, 43 extend angularly upwardly from the lower edges of members 32, 44. By reason of the angular relation between the members of each gusset section, the rib-forming foldline 38 does not extend above plane X—X. To move unit U from its operative mode Y to its inoperative mode Z, merely requires a manual downward pushing force exerted on foldline 38. On the other hand, to move unit U from mode Z to mode Y, merely requires an upward manual pulling force being exerted on the portion of the unit disposed between the hand holes H and foldline 38. In either instance, the upper portions of the end panels 25, 46 may bow outwardly a slight amount depending upon where the manual force is applied. For example, if the applied force is offset relative to the center of foldline 38, one gusset section may move upwardly or downwardly, whatever the case may be, before the other gusset section thereby not causing the upper portions of both end panels to bow outwardly a slight amount.

While the improved carrier 20 is shown to be capable of accommodating two parallel rows of articles, each row comprising three articles, it is to be understood that the invention is not intended to be limited thereto. For example, where the articles are large volume bottles (e.g., 32 ounces) the number of articles accommodated by the carrier may only be two. In this latter instance, the hand-gripping unit U may be positioned so as to separate the two articles.

Referring to FIG. 16, a modified form of carrier 120 is shown wherein the improved hand-gripping unit UU is disposed at an elongated corner formed by a pair of intersecting planes defined by adjoining wall members B, C. In order to facilitate understanding of the carrier 120 relative to carrier 20, like, or similar components of carrier 120 will be identified by the same number, except in the one hundred series.

The hand-gripping unit UU includes a pair of elongated panel sections 136, 137 which are interconnected to one another by an elongated foldline 138. At opposite ends of the foldline 138 are gusset sections 130, 142 which are of like configuration. Each section 130, 142 includes first and second members 131, 132 and 143, 144 which are foldably connected to one another by a foldline 133, 145. Each first member 131, 143 is of triangular configuration with the foldline 133, 145 forming one side thereof and the apex opposite thereto being disposed at the end of foldline 138. The two remaining sides of each first member are foldably connected to corresponding peripheral portions of the adjacent panel sections 136, 137 of the unit UU.

Each second member 132, 144 is foldably connected at 129, 149 to an end flap 125, 146 which is in lieu of the corresponding end panel 25, 46 of carrier 20. The end flaps 125, 146 function as end closure flaps when the carrier is fully set up, as will be described more fully hereinafter. Foldlines 129, 133 and 149, 145 are disposed in spaced, parallel relation.

As noted in FIG. 12, panel sections 136, 137 are struck out from corresponding wall members B, C. Each wall member B, C is, in turn, foldably connected to a corresponding wall member D, E. Foldably connected to the peripheral portion of wall member D, which is opposite wall member B, is a conventional manufacturer's glue flap 126. If desired, however, the glue flap may be foldably connected to wall member E.

Foldably connected to opposite ends of each wall member B—E are end closure flaps B′, B″, C′, C″, D′, D″, E′, E″. When the blank is fully set up, as seen in FIG. 16, the corresponding end closure flaps B′, C′, D′, and E′ coact with end flap 146 and end closure flaps B″, C″, D″, and E″ coact with end flap 125 to form closed end walls for the carrier 120. The end closure flaps and the corresponding end flap are preferably adhesively secured in overlapping end closing relation.

Figure 13:
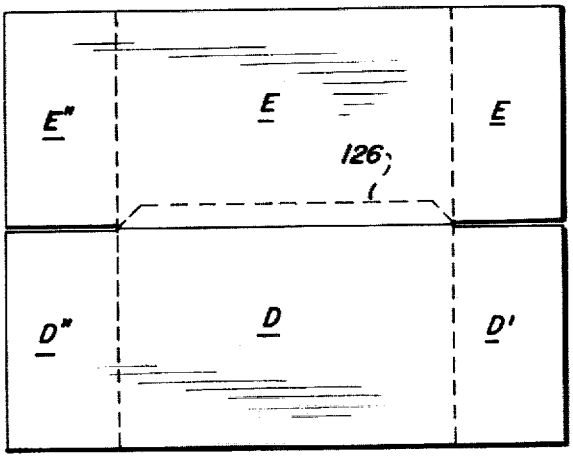
FIG. 13 is a back view of the blank of FIG. 12 in a first folded condition.

In the initial folding of the blank 121, the wall member D and associated end closure flaps D′, D″, and glue flap 126 are folded as a unit about an axis defined by the foldline connecting wall members B, D so as to overlie wall member B and the associated end closure flaps B′, B″. Prior to folding, a suitable adhesive is applied to the surfaces of the glue flap 126, which will be exposed after the initial fold. In a like manner, wall member E and associated end closure flaps E′, E″ are folded as a unit about an axis defined by the foldline connecting wall members C, E so as to overlie wall member C and its associated closure flaps C′, C″. Simultaneously therewith the exposed surface of the glue flap 126, to which a suitable adhesive had been previously applied, is overlaid by and secured to the portion of the concealed surface of the wall member E adjacent the elongated free edge thereof, see FIG. 13. When the blank is in its initially folded state, FIG. 13, it is suitable for storage or for transporting in bulk to the customer for subsequent loading.

As will be noted in FIG. 16, when the carrier 120 is fully set up, the panel sections 136, 137 are folded into face-to-face relation and form a partition which extends into the interior of the carrier at an angle of approximately forty-five degrees (45°) to the wall members B, C. In other words, the partition will bisect an included angle formed between wall members B, C. The bottom of carrier 120, instead of being flat, is substantially V-shaped by reason of the angular disposition of wall members D, E. Thus, the type of product to be accommodated by carrier 120 may be other than the conventional necked bottle, or cylindrical can. For example, it may be a pliable pouch or the like filled with a liquid.

As in the case of carrier 20, the hand-gripping unit UU is adapted to assume either an operative or inoperative mode. When in an inoperative mode, the foldline 138 will be flush with, or recessed from, a plane defined by the foldlines 129, 149. When foldline 138 is so disposed, first and second members 131, 132 and 143, 144 at each end of foldline 138 are angularly disposed relative to one another and define an acute included angle.

On the other hand, when the unit is in an operative mode, the foldline 138 will project beyond the plane defined by foldlines 129, 149 and the first and second members 131, 132 and 143, 144 at each end of foldline 138 will be disposed in a substantially coplanar relation. The unit UU, when in the operative mode, has the holes HH formed in the panel sections 136, 137 readily accessible for engagement by the fingers of a person manually carrying the loaded carrier.

The shape and size of the panel sections 136, 137 may vary from that shown and will depend in part upon the type of product to be accommodated within the carrier 120.

While the invention has heretofore been described with respect to a carrier per se, it may reside in the hand-gripping unit in combination with the end panels or end flaps. In this latter arrangement, the end panels or end flaps would be secured by adhesive or some other suitable means to the ends or sides of a package or basket positioned therebetween.

Thus, it will be seen that a carrier and handle therefor have been provided which are of simple, inexpensive, yet sturdy, construction. The handle is comfortable to grasp and is readily accessible when disposed in an operative mode. When the handle is in an inoperative mode, it is recessed either relative to the articles accommodated by the carrier or a plane defined by exterior portions of the carrier and thus, permits a plurality of similar loaded carriers to be readily stacked for storage, shipment, or display without interference from the handle.

I claim:

1. A carrier handle formed from a blank of foldable sheet material comprising spaced depending end means; and an elongated hand-gripping unit spanning the distance between said end means and being foldably connected to corresponding upper peripheral portions of the latter and manually movable relative thereto between operative and inoperative modes; said unit including a pair of elongated panel sections arranged in face-to-face relation and having upper peripheral segments thereof interconnected by an elongated foldline, the ends of which are spaced inwardly from the end means, and gusset sections disposed intermediate the foldline ends and the adjacent end means, each gusset section having a first member foldably connected to corresponding peripheral portions of said unit panel sections, and a second member foldably connected to said first member and to the upper peripheral portion of the adjacent end means; said gusset section members assuming a folded relation and the folding connection between said second member and the peripheral portion of the adjacent end means being elevated relative to the folding connection between the first and second members of said gusset section, when said unit is in an inoperative mode; said gusset section members assuming a substantially unfolded relation, wherein the folding connection between the first and second members is elevated relative to the folding connection between the second member and the peripheral portion of said adjacent end means, when said unit is in an operative mode.

2. The carrier handle of claim 1 wherein the unit panel sections are provided with aligned hand holes spaced downwardly from said foldline.

3. The carrier handle of claim 1 wherein the end means include end panels disposed in spaced, substantially parallel relation and the folding connections between the upper peripheral portions of the end panels and the gusset section second members are substantially parallel to one another and define a plane, the foldline interconnecting said unit panel sections being substantially disposed within said plane, when said unit is in said inoperative mode, and above said plane when said unit is in said operative mode.

4. The carrier handle of claim 1 wherein the first and second members of each gusset section define a substantially acute angle when said unit is in said inoperative mode, and are in a substantially coplanar relation when said unit is in said operative mode.

5. The carrier handle of claim 3 wherein the unit panel sections are disposed substantially transversely of said parallel end panels, when said unit is in either the operative or inoperative mode.

6. The carrier handle of claim 1 wherein the first member of each gusset section has a substantially triangular configuration and the second member thereof has a substantially trapezoidal configuration; the folding connection between the first and second members being substantially parallel to the folding connection between said second member and the adjacent end means.

7. The carrier handle of claim 1 wherein the second member of each gusset section assumes a substantially fold back face-to-face relation with the interior surface of the end means to which it is foldably connected when said hand-gripping unit is in an inoperative mode.

8. The carrier handle of claim 3 wherein the corresponding lower peripheral portions of said end panels are interconnected by a base panel disposed in spaced, subtending relation with respect to said hand-gripping unit when the latter is in either an operative or inoperative mode.

9. The carrier handle of claim 8 wherein the peripheral portions of the base panel disposed between the end panels have foldably connected thereto upright side panels which span the distance between said end panels, and means for connecting the ends of said side panels to the adjacent end panels.

10. The carrier handle of claim 9 wherein said end panels, said base panel, and said side panels coact to form an open top article-accommodating chamber, and said hand-gripping unit effects substantial separation of said chamber into contiguous compartments, when said unit is in either an operative or inoperative mode.

11. The carrier handle of claim 1 wherein the end means includes depending end flaps disposed in spaced, endwise relation with respect to the ends of the elongated foldline interconnecting the panel sections of the hand-gripping unit.

12. The carrier handle of claim 11 wherein the panel sections of the hand-gripping unit are struck out from angularly disposed wall members, said panel sections being disposed in substantially face-to-face relation and forming a partition substantially bisecting an included angle formed between said wall members.

13. The carrier handle of claim 12 wherein the wall members are provided with foldable end closure flaps, said closure flaps coacting with a corresponding depending end flap to form an end wall, the latter being substantially transversely disposed relative to said wall members.

14. A blank of foldable sheet material for forming a handle having a pair of opposed end means disposed in spaced relation and a hand-gripping unit extending between and being foldably connected to the end means, said blank comprising a pair of elongated panel sections arranged in side by side relation and having corresponding side edges interconnected by an elongated foldline, a pair of end means spaced from opposite ends of said foldline, and a pair of gusset sections interposed the foldline ends and the end means; each gusset section including a triangular first member having an apex thereof coincident to an end of the foldline and a side edge thereof opposite said apex foldably connected to a second member, the remaining sides of said triangular first member being foldably connected to adjacent corresponding peripheral portions of said panel sections, said second member being foldably connected to an adjacent peripheral portion of an end means, the folding connection between said first and second members being substantially parallel to the folding connection between said second member and said end means.

* * * * *